US005294188A

United States Patent [19]

Vancil, Jr.

[11] Patent Number: 5,294,188

[45] Date of Patent: Mar. 15, 1994

[54] ILLUMINATED ROLLER SKATE WHEEL

[76] Inventor: Joe F. Vancil, Jr., 3210 Alpha Dr., Paducah, Ky. 42003

[21] Appl. No.: 994,361

[22] Filed: Dec. 21, 1992

[51] Int. Cl.[5] ..... B60B 5/02

[52] U.S. Cl. ..... 301/5.3; 362/78

[58] Field of Search ..... 301/5.3, 5.7; 362/78, 362/35

[56] References Cited

U.S. PATENT DOCUMENTS

| | | | |
|---|---|---|---|
| 3,789,208 | 1/1974 | Lewis | 362/78 X |
| 4,289,323 | 9/1981 | Roberts | 301/5.7 X |
| 4,298,910 | 11/1981 | Price | 301/5.7 X |
| 4,363,502 | 12/1982 | Bakerman | 301/5.7 X |
| 4,383,244 | 5/1983 | Knauff | 362/78 X |

*Primary Examiner*—Russell D. Stormer
*Attorney, Agent, or Firm*—Leon Gilden

[57] ABSTRACT

A roller skate wheel having a conical cavity includes an insert housing arranged for complementary reception within the cavity. The housing includes a housing base plate, with the base plate including a socket to receive the wheel fastening axle structure therewithin. A transparent forward plate is mounted in a spaced, parallel relationship relative to the base plate. A plurality of illumination bulbs diametrically aligned within the housing adjacent the forward plate are in electrical communication with a battery housing mounted medially of the housing, and wherein the battery and battery housing include first electrical contact support legs resiliently mounted, with the first electrical contacts mounted to distal ends of the legs for engagement with further electrical contact legs directed into the illumination bulbs, whereupon centrifugal force in use of the roller skate wheel completes electrical circuitry to effect illumination of the bulbs within the housing.

2 Claims, 4 Drawing Sheets

ILLUMINATED ROLLER SKATE WHEEL

BACKGROUND OF THE INVENTION

1. Field of the Invention

The field of invention relates to roller skate apparatus, and more particularly pertains to a new and improved illuminated roller skate wheel wherein the same is directed to effect illumination within the wheel upon rotation of the wheel.

2. Description of the Prior Art

Illuminated roller skate wheel structure has been addressed in the prior art and exemplified in U.S. Pat. No. 4,648,610 to Hegyi utilizing a self-generating apparatus to provide for illumination through a roller skate wheel. Illuminated roller skate wheel structure is further exemplified in U.S. Pat. Nos. 4,336,573; 4,463,412; and 4,363,502.

The instant invention sets forth a wheel structure arranged to provide for illumination of the wheel during rotation thereof utilizing centrifugal force to provide for completion of electrical circuitry within a wheel structure and in this respect, the present invention substantially fulfills this need.

SUMMARY OF THE INVENTION

In view of the foregoing disadvantages inherent in the known types of illuminated roller skate wheel apparatus now present in the prior art, the present invention provides an illuminated roller skate wheel wherein a switch structure is closed during rotation of the wheel by centrifugal force. As such, the general purpose of the present invention, which will be described subsequently in greater detail, is to provide a new and improved illuminated roller skate wheel.

To attain this, the present invention provides a roller skate wheel having a conical cavity including an insert housing arranged for complementary reception within the cavity. The housing includes a housing base plate, with the base plate including a socket to receive the wheel fastening axle structure therewithin. A transparent forward plate is mounted in a spaced, parallel relationship relative to the base plate. A plurality of illumination bulbs diametrically aligned within the housing adjacent the forward plate are in electrical communication with a battery housing mounted medially of the housing, and wherein the battery and battery housing include first electrical contact support legs resiliently mounted, with the first electrical contacts mounted to distal ends of the legs for engagement with further electrical contact legs directed into the illumination bulbs, whereupon centrifugal force in use of the roller skate wheel completes electrical circuitry to effect illumination of the bulbs within the housing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved illuminated roller skate wheel which has all the advantages of the prior art roller skate wheel apparatus and none of the disadvantages.

It is another object of the present invention to provide a new and improved illuminated roller skate wheel which ay be easily and efficiently manufactured and marketed.

It is a further object of the present invention to provide a new and improved illuminated roller skate wheel which is of a durable and reliable construction.

An even further object of the present invention is to provide a new and improved illuminated roller skate wheel which is susceptible of a low cost of manufacture with regard to both materials and labor, and which accordingly is then susceptible of low prices of sale to the consuming public, thereby making such illuminated roller skate wheels economically available to the buying public.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
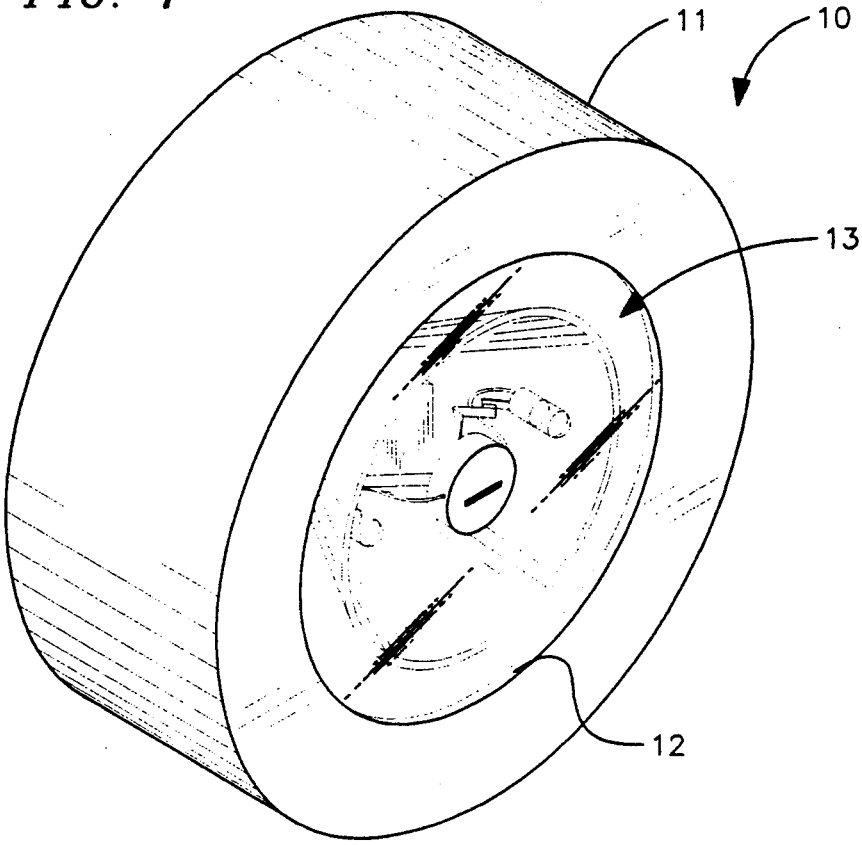
FIG. 1 is an isometric illustration of the invention.
Figure 2:
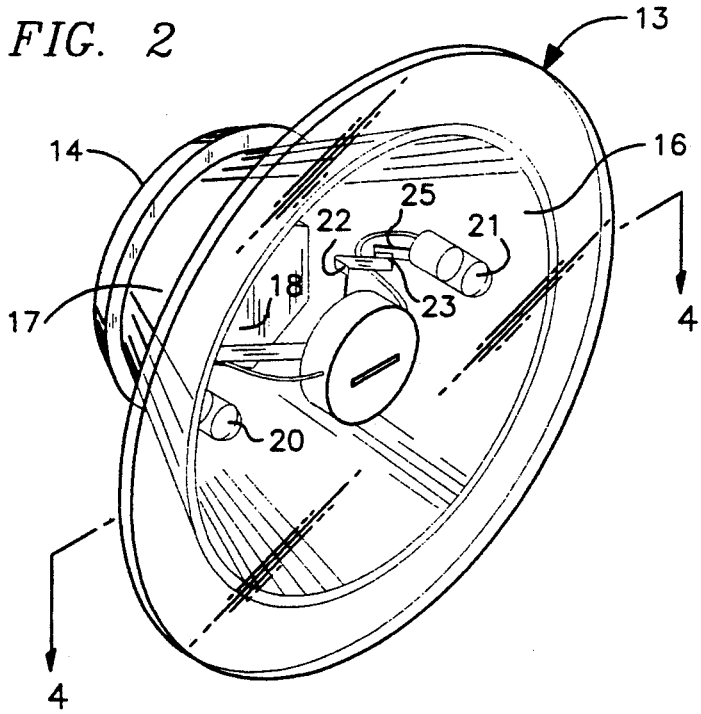
FIG. 2 is an isometric illustration of the insert housing of the invention.
Figure 3:
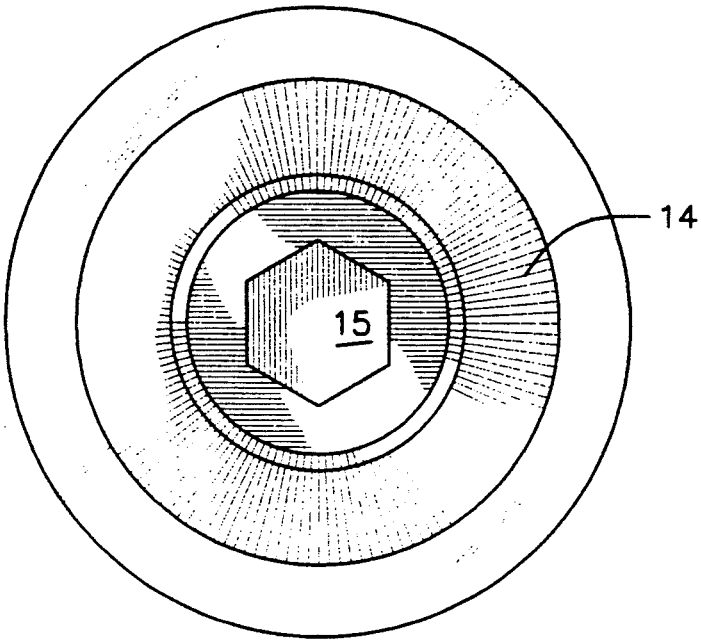
FIG. 3 is an orthographic rear view of the insert housing.

With reference now to the drawings, and in particular to FIGS. 1 to 7 thereof, a new and improved illuminated roller skate wheel embodying the principles and concepts of the present invention and generally designated by the reference numeral 10 will be described.

Figure 4:
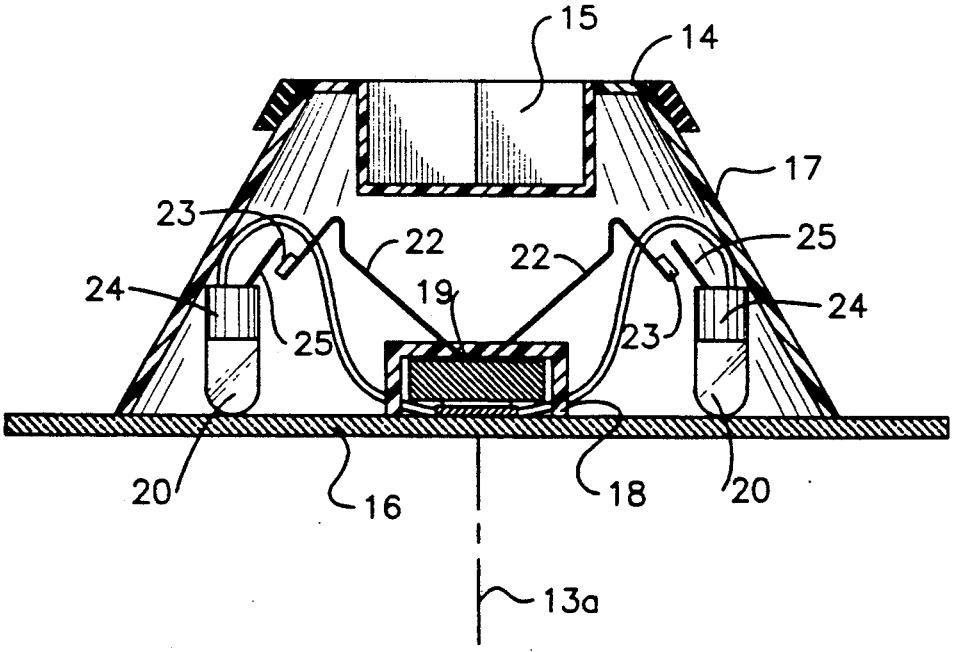
FIG. 4 is an orthographic cross-sectional illustration of the insert housing.
Figure 5:
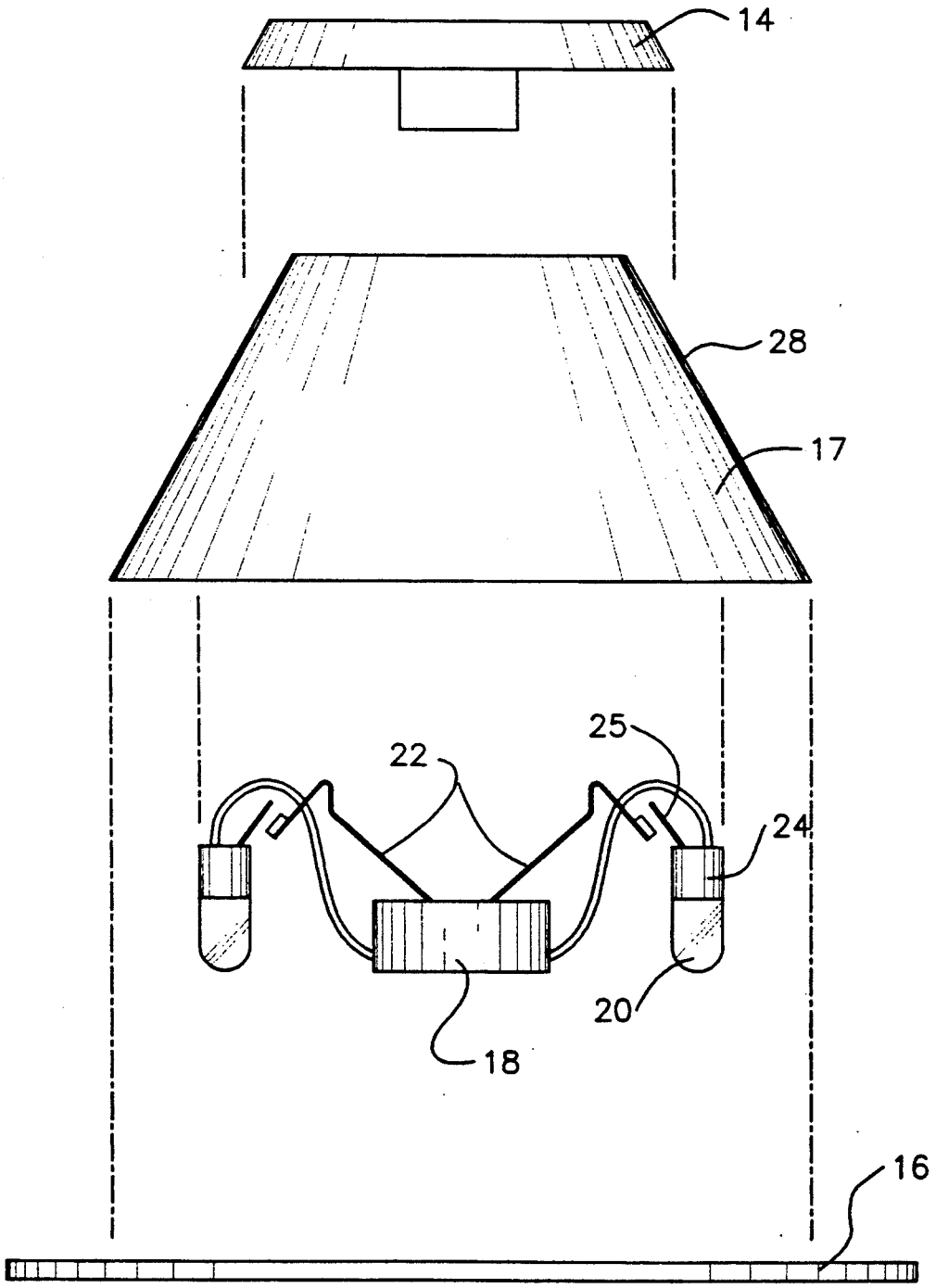
FIG. 5 is an exploded orthographic view of the housing structure.

More specifically, the illuminated roller skate wheel 10 of the instant invention essentially comprises the wheel structure 11 having a wheel conical cavity 12 to receive an illumination insert housing 13. The insert housing 13 is symmetrically oriented about a housing axis 13*a* (see FIG. 4). The housing includes an insert base plate 14 spaced from and parallel a transparent forward plate 16. The transparent plate 16 may be formed of translucent material and may be of various colorations. A socket 15 is directed into the base plate 14 directed towards the forward plate 16 symmetrically oriented about the axis 13*a*, as indicated in FIG. 4, for reception of the wheels axle and securement fastener. Such axle and securement fastener structure is typical of roller skate wheel construction and as exemplified in U.S. Pat. No. 4,648,610 incorporated herein by reference.

The insert housing is further formed with a conical side wall 17 for complementary reception within the wheel conical cavity 12. Further, the conical side wall 17 is arranged to include an adhesive layer 28 (see FIG. 5) for fastening of the housing within the wheel structure. A battery housing 18 is mounted within the housing in adjacency to the forward plate 16 along the axis 13*a*. A plurality of illumination bulbs 20 are diametrically aligned relative to one another and mounted within the housing symmetrically spaced from the axis 13*a*. The battery housing 18 includes a battery 19 therewithin, with a plurality of L-shaped electrical contact support legs 22 extending in electrical communication to the battery, each having a weighted electrical contact 23 at a free distal end of each contact leg spaced from the battery housing and battery 18 and 19 respectively. Each of the illumination bulbs 20 is mounted within an electrical bulb socket 24, with each bulb socket 24 having a rigid electrical contact leg 25 extending therefrom. Upon rotation of the roller skate wheel 11, the weighted electrical contacts 23 project for electrical communication with the rigid electrical contact legs 25 to complete electrical circuitry from the battery through the bulbs 20 for illumination of the bulbs. To this end, the L-shaped contact legs are of a resilient shape retentive material, wherein each of the weighted electrical contacts 23 is spaced from an associated contact leg 25 but upon rotation of the wheel 11, the electrical contact 23 extends radially from the battery housing and battery for electrical communication with the rigid contact leg 25.

Figure 6:
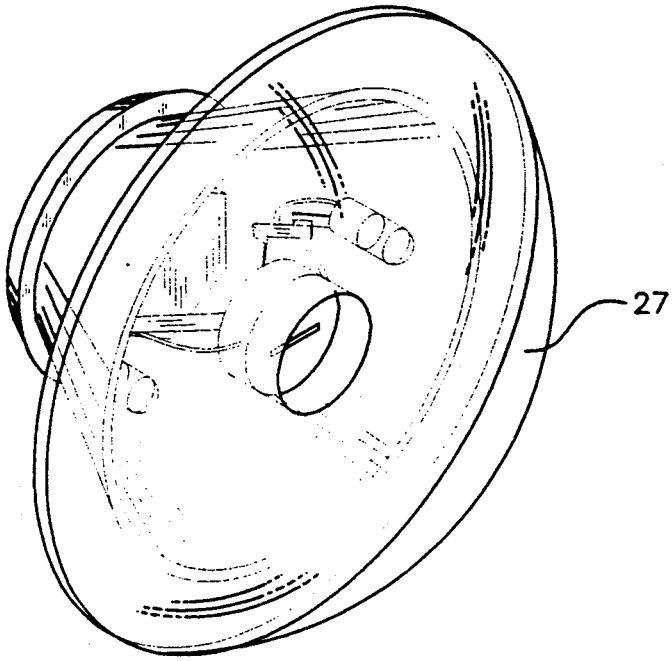
FIG. 6 is an isometric illustration of the insert housing employing a convex forward plate.
Figure 7:
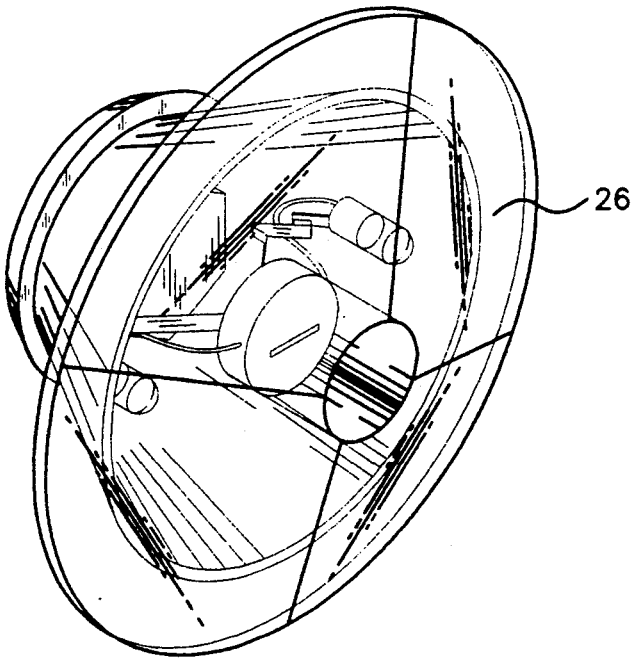
FIG. 7 is an isometric illustration of the insert housing employing a prismatic forward plate.

The FIGS. 6 and 7 indicate the use of a concave forward plate 27 and a prismatic forward plate 26 respectively for alternative use relative to the forward plate 16. Further, the forward plates 16 or 26, 27 may be removable relative to the housing for maintenance of the battery 19 or may alternatively be sealed within the housing.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An illuminated roller skate wheel, comprising, a roller skate wheel having a wheel conical cavity, and an insert housing, the insert housing symmetrically oriented about a housing axis, and further including an insert base plate, and a transparent forward plate spaced from the base plate, with the base plate mounted at a first end of the insert housing, and the forward plate mounted at a second end of the insert housing, with the base plate and the forward plate symmetrically oriented about the axis, the insert housing further including a truncated conical side wall extending between the base plate and the forward plate, and illumination means mounted within the insert housing for illumination upon rotation of the wheel, and the illumination means includes a battery housing mounted fixedly within the insert housing and symmetrically about the axis, and a plurality of illumination bulbs mounted on opposed sides of the battery housing an equal distance relative to one another, with each illumination bulb including an electrical bulb socket, and each electrical bulb socket including a rigid electrical contact leg, and the battery housing including a battery therewithin, and the battery having a plurality of L-shaped electrical contact support legs positioned in adjacency in a spaced relationship relative to one of said electrical contact legs, and each of the support legs having a support leg free distal end, and each free distal end mounting a weighted electrical contact, whereupon rotation of the wheel effects projection of the weighted electrical contact into electrical communication with one of the rigid electrical contact legs.

2. A roller skate wheel as set forth in claim 1 wherein each of the L-shaped electrical contact support legs are formed of a resilient shape retentive material for maintaining a spaced relationship relative to the rigid electrical contact legs, and wherein upon rotation of the wheel the L-shaped electrical contact support legs are directed into communication with the rigid electrical contact legs by centrifugal force.

* * * * *